US006060174A

United States Patent [19]

Sabol et al.

[11] Patent Number: 6,060,174

[45] Date of Patent: May 9, 2000

[54] BOND COATS FOR TURBINE COMPONENTS AND METHOD OF APPLYING THE SAME

[75] Inventors: Stephen M. Sabol, Orlando; John G. Goedjen, Oviedo, both of Fla.

[73] Assignee: Siemens Westinghouse Power Corporation, Orlando, Fla.

[21] Appl. No.: 09/318,902

[22] Filed: May 26, 1999

[51] Int. Cl.[7] ..... B32B 9/00

[52] U.S. Cl. ..... 428/610; 428/621; 428/633; 428/678; 420/437; 420/440; 420/443; 420/445; 416/241 R

[58] Field of Search ..... 428/610, 621, 428/632, 633, 678, 680, 704; 148/426, 427, 428; 420/437, 440, 441, 442, 443, 445; 416/241 R

[56] References Cited

U.S. PATENT DOCUMENTS 3,692,501 9/1972 Hoppin et al. .
3,741,791 6/1973 Maxwell et al. .
4,034,142 7/1977 Hecht .
4,321,311 3/1982 Strangman .
5,180,285 1/1993 Lau .
5,316,866 5/1994 Goldman et al. .
5,562,998 10/1996 Strangman .
5,683,825 11/1997 Bruce et al. .
5,712,050 1/1998 Goldman et al. ..... 428/680
5,952,110 9/1999 Schell et al. ..... 428/621

*Primary Examiner*—Timothy Speer
*Assistant Examiner*—Bryant Young

[57] ABSTRACT

A substrate (12) such as a superalloy turbine component is coated with a basecoat (14) of the type MCrAlY which also contains boron, where the amount of boron in the basecoat is in a concentration gradient where more boron is present near the top (16) than the bottom (20) of the basecoat (14) and boron is present in an average amount of over 0.50 wt. % throughout the basecoat cross-section (14) of the composite (10).

7 Claims, 1 Drawing Sheet

BOND COATS FOR TURBINE COMPONENTS AND METHOD OF APPLYING THE SAME

BACKGROUND OF THE INVENTION

1. Field of the Invention

This invention relates to a partially "transient" boron additive for MCrAlY type basecoats which are deposited on superalloy, high temperature turbine substrates. The boron additive improves the density and coating quality of the basecoat.

2. Background Information

A cobalt or nickel based superalloy of, for example, the elements Ni.Cr.Al.Co.Ta.Mo.W, has been used for making blades, vanes, and other components for gas turbines. These turbine components are generally protected by a basecoat of MCrAlY, where M is selected from the group consisting of Fe, Co, Ni and their mixtures. These basecoats are usually covered by an oxidative overcoat layer and a final thermal barrier coating, as taught, for example, in U.S. Pat. Nos. 5,180,285; 5,562,998; and 5,683,825 (Lau, Strangman, and Bruce et al., respectively).

In some instances, a separate substrate contacting layer is used at the interface between the substrate and the MCrAlY basecoat. For example, an aluminide or platinum layer is mentioned as a separate substrate contacting layer to provide basecoat durability in U.S. Pat. No. 4,321,311 (Strangman).

All these turbine components operate in high temperature environments, and generally the higher the temperature the more efficiency can be realized, within materials limitations. One of these materials limitations is attachment of turbine components to each other, and attachment of the MCrAlY and other layers to the superalloy substrate of the turbine blade, or the like.

Bonding powders, including temperature depressants, selected from at least one of B, Si, Mn, and Ta, as well as precipitation strengthening elements, such as Al and Ti, and solution strengthening elements, such as Mo or W, have been added from 1 wt % to 15 wt % in nickel base superalloy compositions to allow ease of brazing turbine airfoils, and the like, to base portions at overlap and butt joints, as taught in U.S. Pat. No. 3,692,501 (Hoppin et al.). About 0.5 wt. % to 16 wt. % silicon has been added to a FeCrAlY type nitrocellulose slurry, for spray painting on nickel base superalloys, followed by a diffusion heat treatment. These compositions provide an adherent, oxidation resistant coating, as taught by U.S. Pat. Nos. 3,741,791 and 4,034,142 (Maxwell et al. and Hecht, respectively). In U.S. Pat. No. 5,316,866 (Goldman et al.) a Ni.Co.Cr.Al.Mo.Ta.W coating, also containing under 0.1 wt. % C,B, and Zr, was substituted for the standard MCrAlY composition, next to a nickel-based superalloy. Amounts of C over about 0.07 wt. % or B, or Zr over about 0.030 wt. % are taught as causing grain boundary embrittlement.

What is still needed, however, are denser, higher quality, less expensive MCrAlY type basecoats, which can be used without a separate thermal barrier layer. Protective MCrAlY base coats are still used as protection for turbine components. While these coatings have made significant technical contributions to the industry, they still suffer from high cost and variable quality. Some areas of turbine components, such as fillet regions, are particularly difficult to coat using standard MCrAlY type basecoats. Frequently the applied MCrAlY coating will contain excessive porosity, which can result in poor performance. What is also needed is an alternative coating process which provides exceptional bonding and high densification of the MCrAlY coating, providing increased performance and superior turbine component protection.

SUMMARY OF THE INVENTION

Therefore, it is one of the main objects, of this invention to provide improved MCrAlY type basecoats, having outstanding adherence to a substrate, high density, offering superior protection in hostile thermal environments, and allowing decreased production costs.

It is another main object of this invention to provide a low cost method to produce improved MCrAlY type basecoats.

These and other objects of the invention are accomplished by providing a turbine component, comprising a substrate and at least one layer of a basecoat composition of the MCrAlY type, where M is selected from the group consisting of Fe, Co, Ni and their mixtures, where at least the basecoat contains boron (B) throughout its cross-section in an average amount over 0.50 wt. %, and where the density of the basecoat is over 95% of theoretical density. A top thermal barrier coating ("TBC") can be disposed on top of the basecoat if desired. The basecoat composition, as applied to the substrate, that is, in the "green" state, will have a concentration of B between about 1 wt. % and about 4 wt. %. After a heat treatment of the "green" basecoat, the final basecoat will have a concentration gradient of B from about 0.5 wt. % to about 3 wt. % near the top surface, to about 0.05 wt. % to about 0.07 wt. % near the basecoat interface surface where it contacts the substrate.

Further objects of the invention are accomplished by the method of coating a substrate with a basecoat, comprising: (1) providing a metal substrate, (2) applying a basecoat composition to the substrate, where the basecoat composition is of the MCrAlY type, where M is selected from the group consisting of Fe, Co, Ni and their mixtures, and where boron (B) is present in the composition at a concentration of between about 1 wt. % and about 4 wt. %, to provide a solid basecoat attached to the substrate, and (3) heating the coated substrate at a temperature and for a time effective to cause the applied basecoat to flow and condense and form a densified coating over 95% of theoretical density, where part of the boron is dissipated, passing out of the basecoat to provide an average concentration of boron throughout the basecoat cross-section of over 0.50 wt. %. The basecoat and substrate can then be allowed to cool. If desired, a thermal barrier coating can be applied over the basecoat.

BRIEF DESCRIPTION OF THE DRAWINGS

The above and other advantages of the invention will be more apparent from the following description in view of the drawings in which.

DESCRIPTION OF THE PREFERRED EMBODIMENT

Figure 1:
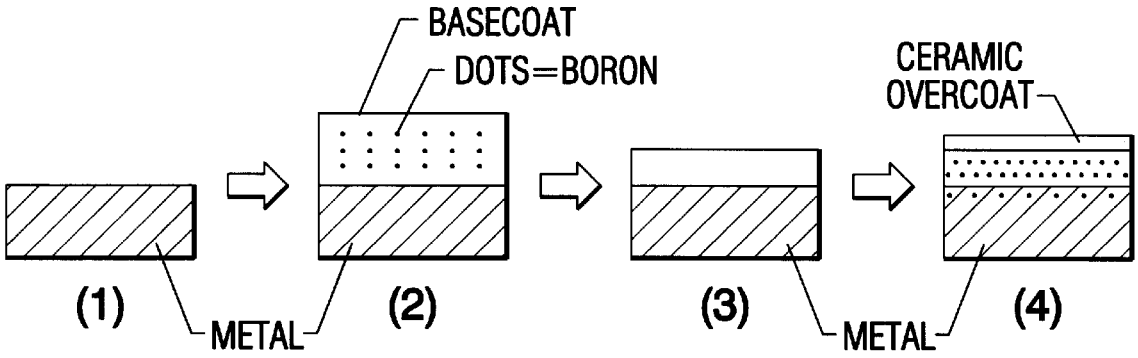
FIG. 1 is a block diagram of one method of this invention.

Referring now to FIG. 1, a method of coating a metal substrate with a basecoat is shown. The substrate shown in step (1), also shown as 12 in FIG. 2, can be a turbine component which in operation in a turbine is subject to severe thermal stress in the temperature range of 1000° C. to 1100° C. This turbine component can be a turbine blade, a turbine vane, a turbine bucket, a turbine nozzle, various joints or fillet regions within the turbine, or the like coatings in joints or fillet regions may be more porous than in other locations on turbine components, and such areas benefit especially from the basecoat of this invention. The metal substrate itself is usually a cobalt or nickel based superalloy of, for example, the elements Cr.Al.Co.Ta.Mo.W.

The basecoat composition can be applied to the metal substrate in step (2) of FIG. 1 by means of conventional thermal spray techniques, such as plasma spraying, low pressure plasma spraying or high velocity oxy-fuel processes. The basecoat composition used here can also be applied, as a powder slurry in a liquid medium by a less expensive slurry spray, electrophoretic coating or electrostatic powder coating process. The basecoat, shown in FIG. 1 step (2), will preferably have a homogeneous distribution of the components of the basecoat composition through the volume, as shown. The initial coating composition itself is of the MCrAlY type, which means M is generally selected from the group consisting of Fe,Co,Ni and their mixtures, but where a typical composition would contain, on a dry powder basis, about 7 wt. % to 20 wt. % Cr, about 5 wt % to 10 wt. % Al, about 0.2 wt. % to about 3 wt. % Y, about 1.0 wt. % to about 4 wt % B, where up to about 1 wt % each of Ti, Mo, Ta, W, Re, Hf, C, and Zr may also be present, with the balance being Ni, Co or Fe. Thus, other elements can be present, as is well-known in the art in this "type" superalloy coating; with Y also representing elements such as: Y itself, and Ti, Mo, Ta, W, Re, Hf, C, Zr, and their mixtures, as is well known. Thus the MCrAlY type alloy can consist essentially of Fe, Co, Ni, Y, B, Ti, Mo, Ta, W, Re, Hf, C and Zr. Boron (B) shown as dots in the figures, is present in a homogeneous mixture through the composition between the range of about 1 wt. % to about 4 wt. % on a dry basis, that is, based on the powder composition. The composition may be a single mixture containing boron or it can be a 60%–40% to 30%–70% blend of boron containing—to non-boron containing powder, that is, from 30% to 60% boron containing powder in a mixed blend. The blend of powders can help provide a shorter diffusion path for the boron so that the temperature resistance of the final coating is increased. Boron must be present in the composition that is to be applied to the substrate in the range of at least about 1 wt. %, to help in the melt liquification, condensation densification step shown as (3) in FIG. 1.

In step (3), the coated substrate is heated, preferably in a vacuum or in an inert atmosphere, at a temperature and for a time effective to cause the applied basecoat composition to flow and "collapse" or "condense" as it liquifies and melts, generally between about 1000° C. and 1350° C., for about 1 hour to 3 hours. The use of boron depresses the melting point which allows the composition to condense and form a densified coating during step (3). Since the composition will condense during step (3) to a final film in step (4) of about 0.005 cm to 0.04 cm thick upon cooling, a much thicker layer of basecoat composition can be applied in step (2) than during the normal formation of MCrAlY type films so that a more massive volume is achieved. The preferred thickness of the basecoat after step (3) is from about 0.01 cm to 0.03 cm. The coating in step (2) will be applied to a thickness appropriate to provide a final film within the above thickness range. During this step, part of the boron is dissipated, escaping and passing out of the basecoat. The remainder of the Boron is homogenized within the bond coat to solidify the "transient" liquid phase.

Figure 2:
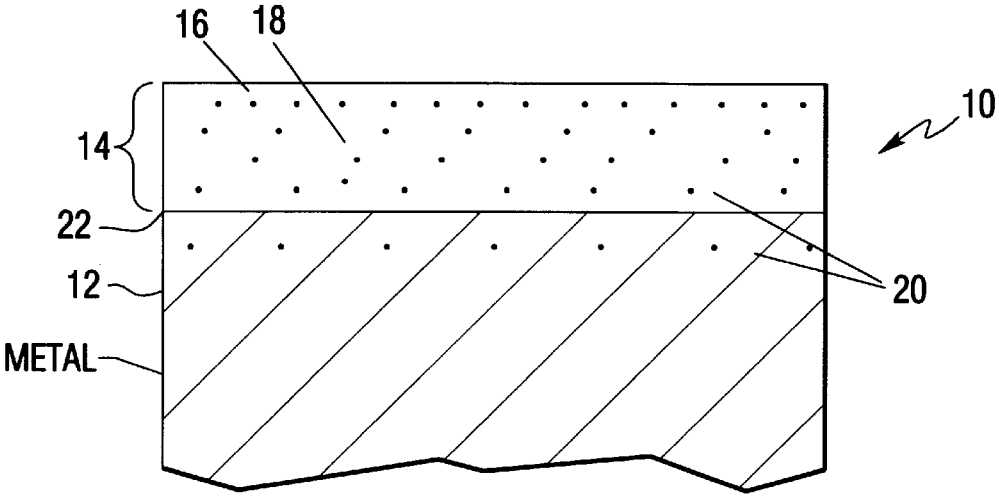
FIG. 2, which best shows the invention, is a sectional fragmented view of the heat treated basecoat and its interface with a substrate, showing the boron (B) concentration gradient throughout the basecoat and substrate, corresponding to a "green" coating just after an initial heat treatment in step (3) of FIG. 1.

Densification during step (3) is to over 95% of theoretical density, that is, under 5% porous. Under ideal conditions, a film 97% to 99% of theoretical density can be formed. If a thermal barrier coating ("TBC") is to be applied, additional heat treatment in air during step (4) can form a protective aluminum oxide layer as a base for the TBC. The boron gradient achieved after step (3) is more clearly illustrated in FIG. 2, and is from about 0.5 wt. % to about 3 wt. % of the volume cross-section near the top surface of the basecoat, as at point 16, with lower amounts as at point 18. There are even lower amounts as at points 20 of from about 0.05 wt. % to about 0.07 wt. % of the volume cross-section at that level, that is, a slice across the volume at that level would provide about 0.05 wt. % to about 0.07 wt. % boron based on boron content as elemental boron or as borides. The overall or average concentration of boron throughout the entire basecoat cross-section 14, is over 0.50 wt. %, and is preferably from about 0.50 wt. % to about 1 wt. % based on boron content as elemental boron or borides. Since the coating of step 2 is relatively thick, a substantial amount of boron remains, as shown in FIG. 2. This does not particularly affect the melting point of the base coat, since the turbine component will generally operate at or below 1100° C. As shown, some boron diffuses across interface 22 into the substrate as at the lower level 20 in the substrate 12 which may actually help in bonding. It is not desirable, however, to form any separate boron layer at the interface 22.

By adding boron (B) to the basecoat composition, and heating in steps (2) and (3) of FIG. 1, a liquid phase would start to form, allowing densification of the basecoat as its thickness decreased. That same heating step also serves to dissipate a substantial amount of the B present, so that upon cooling in steps (3) and (4), the temperature resistance of the basecoat as it starts use in a turbine environment returns to about 1200° C. to 1300° C., and will increase slightly with increased use in the turbine environment.

As a useful Example of preparing the basecoats of this invention, a nickel based superalloy turbine blade containing at least the elements Ni.Cr.Al.Co.Ta.Mo.W would be coated with a single layer of basecoat material by an electrostatic coating process to provide an adherent coating about 0.05 cm thick. The coating would contain at least Ni.Cr.Al.Y, and about 1 wt. % to 4 wt. % boron.

The coated turbine blade would then be placed in a vacuum and heated to 1200° C. for about 2 hours, causing the coating to condense to a thickness of about 0.03 cm and to dissipate a substantial amount of the boron present, so that, upon cooling, the boron would have a concentration gradient within the coating thickness and contain an average amount of boron through its cross-section of from 0.50 wt. % to about 1 wt. %, based on boron content as elemental boron or as borides. The coating would be about 97% dense and would be protective of the superalloy at temperatures of about 1000° C. to 1100° C. or higher.

While applicants have used the term "comprising", which equals openterminology, it is to be understood that they are not thus limited and may also use narrower terminology such as "consisting essentially of" and "consisting of", consistent with U.S. case law.

While specific embodiments have been described, it will be appreciated by those skilled in the art that various modifications and alternatives could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A composite comprising a substrate and at least one layer of an MCrAlY basecoat composition, where M is selected from the group consisting Fe,Co,Ni and their mixtures, where at least the basecoat contains boron throughout its cross-section in an average amount over 0.50 wt. %; and where the density of the basecoat is over 95% of theoretical density.

2. The composite of claim 1, where the composite is a turbine component.

3. The composite of claim 1, where a thermal barrier coating is disposed over the basecoat.

4. The composite of claim 1, where the basecoat has a top surface, and an interface surface where it contacts the substrate, and where boron is present in the basecoat in a concentration gradient from about 0.5 wt. % to about 3 wt. % near the top surface and from about 0.05 wt. % to about 0.07 wt. % near the basecoat interface surface.

5. The composite of claim 1, where the basecoat contains boron and borides thought through its cross-section in an average amount of from 0.50 wt. % to about 1 wt. %, based on boron content as elemental boron or as borides.

6. The composite of claim 1 having a basecoat with a density between 97% and 99% of theoretical density.

7. The turbine component of claim 2 within a turbine in an operating turbine environment.

* * * * *